US005385388A

United States Patent [19]

Faiks et al.

[11] Patent Number: 5,385,388

[45] Date of Patent: * Jan. 31, 1995

[54] SPLIT BACK CHAIR

[75] Inventors: Frederick S. Faiks, Greenville; Carl V. Forslund, III; Robert M. Scheper, both of Grand Rapids; Craig M. Anderson; Glenn A. Knoblock, both of Kentwood; Dale M. Groendal, Jenison, all of Mich.

[73] Assignee: Steelcase Inc., Grand Rapids, Mich.

[ * ] Notice: The portion of the term of this patent subsequent to Oct. 5, 2010 has been disclaimed.

[21] Appl. No.: 130,583

[22] Filed: Oct. 1, 1993

Related U.S. Application Data

[63] Continuation-in-part of Ser. No. 790,348, Nov. 12, 1991, Pat. No. 5,249,839.

[51] Int. Cl.[6] ..... A47C 3/00

[52] U.S. Cl. ..... 297/301; 297/284.4

[58] Field of Search ..... 297/301, 304, 300, 322, 297/354.1, 354.11, 353, 284.4, 284.7, 452.3, 452.15

[56] References Cited

U.S. PATENT DOCUMENTS

| | | |
|---|---|---|
| 299,846 | 6/1884 | Parry . |
| 2,563,951 | 8/1951 | Mondy . |
| 3,059,971 | 10/1962 | Becker . |
| 3,806,075 | 4/1974 | Sturhan . |
| 4,019,777 | 4/1977 | Hayashi . |
| 4,262,871 | 4/1981 | Kolk et al. . |
| 4,485,996 | 12/1984 | Beukema et al. . |
| 4,714,291 | 12/1987 | Hattori et al. . |
| 4,756,575 | 7/1988 | Dicks . |
| 4,904,020 | 2/1990 | Hollesen . |
| 4,981,325 | 1/1991 | Zacharkow . |
| 4,981,326 | 1/1991 | Heidmann . |
| 5,026,117 | 6/1991 | Faiks et al. . |
| 5,042,876 | 8/1991 | Faiks . |
| 5,062,676 | 11/1991 | Mars . |

FOREIGN PATENT DOCUMENTS

| | | |
|---|---|---|
| 226408 | of 0000 | Austria . |
| 2360165 | of 0000 | Germany . |
| 2501673 | of 0000 | Germany . |
| 3125312 | of 0000 | Germany . |
| 413263 | of 0000 | Switzerland . |
| 674251 | of 0000 | United Kingdom . |
| 840946 | of 0000 | United Kingdom . |
| 925337 | of 0000 | United Kingdom . |

*Primary Examiner*—Laurie K. Cranmer

*Attorney, Agent, or Firm*—Price, Heneveld, Cooper, DeWitt & Litton

[57] ABSTRACT

A chair, with independent control of a lumbar portion of a seat back and a thoracic portion of the seat back, has a seat connected with a base and a control connected with the base, generally under the seat. A first support, pivotally connected with the control, extends from the control to the thoracic portion of the seat back. A second support extends to the lumbar portion of the seat back. The two supports operate independently and the thoracic and lumbar portions of the seat back rotate independently rearward with respect to the seat, providing sympathetic back support for a user. The thoracic portion may rotate laterally to follow twisting movements of a user's thoracic region. The lumbar portion may be connected with the second support to limit lateral rotation of the lumbar portion.

12 Claims, 6 Drawing Sheets

SPLIT BACK CHAIR

CROSS REFERENCE TO RELATED APPLICATION

This is a continuation-in-part application of copending U.S. application Ser. No. 07/790,348 filed Nov. 12, 1991 and now U.S. Pat. No. 5,249,839.

BACKGROUND OF THE INVENTION

The present invention relates to seating and, in particular, to control of a back support portion of a chair.

It is known to provide various lumbar support devices to support the back of a user properly and comfortably. Back support portions of known chairs generally dictate the positioning and allowable movements of a user's back. These devices are commonly fabricated according to a model representing a compromise of the range of forms and shapes of the ultimate users of the chair. The actual user seldom matches the composite model. The user is inevitably required to adapt to the chair, rather than having the chair adapt to the user. Thus, prior art chairs can cause stress and fatigue in the user.

SUMMARY OF THE INVENTION

A chair according to the present invention departs from the dictatorial back supports of prior chairs with a sympathetic back support mechanism, having designed motions adapted to follow and support the natural body motions of the user and thereby minimize seating stress and fatigue. The chair has a seat connected with a base, a control connected with the base and disposed generally underneath the seat and a back support connected with the control. The back support has a lumbar portion positioned to contact at least a portion of a lower back area of a user and a thoracic portion positioned to contact at least a portion of an upper back area of the user. A first or thoracic support is pivotally mounted in the control and extends to connect with the thoracic portion of the back support so that the thoracic portion rotates rearward with respect to the seat. A second or lumbar support connects with the lumbar portion of the back. The lumbar portion rotates rearward with respect to the seat independently of rotation of the thoracic portion and said first support to achieve a natural, free-floating chair back motion and providing generally continuous, sympathetic back support.

In narrower aspects of the invention, a flexible transition zone is provided between the lumbar and thoracic portions of the back. The thoracic portion of the back is connected with the first support so that the thoracic portion rotates laterally to follow twisting movements of a user's upper back region. The lumbar portion of the back is connected with the second support to minimize lateral rotation of the lumbar portion. The first support, connected with the thoracic portion of the back, is a telescoping member. The second support is connected with the lumbar portion of the back by a height adjustment mechanism for adjusting the height of the back relative to the seat.

These and other objects, advantages and features of the present invention will become apparent upon review of the following specification in conjunction with the drawings.

DESCRIPTION OF THE PREFERRED EMBODIMENT

Figure 1:
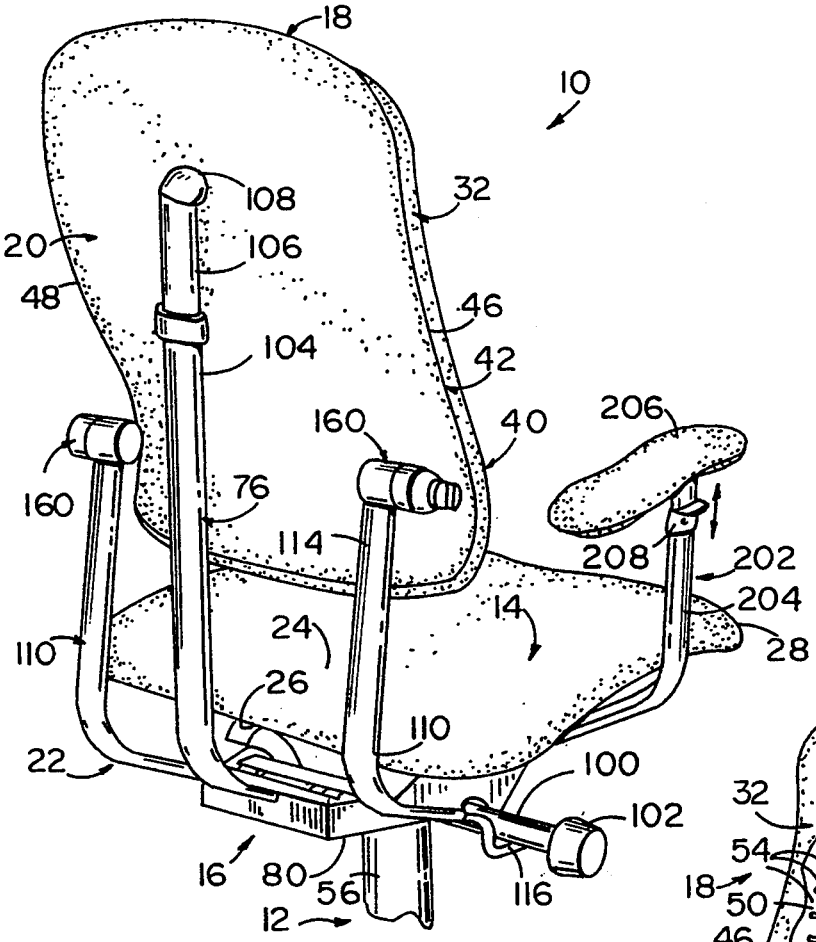
FIG. 1 is a rear perspective view of a chair according to the present/invention.

A chair 10 according to the present invention is generally shown in the figures and comprises a base 12, a seat 14, a control 16, a back 18, a first or thoracic support 20 and a second or lumbar support 22 (FIG. 1). As discussed below, thoracic support 20 includes a thoracic support arm and a thoracic energy mechanism and lumbar support 22 includes lumbar support arms and a lumbar energy mechanism.

Seat 14 may be any of various known constructions, preferably comprising a molded, upholstered chair cushion assembled to a structural shell and is most preferably constructed according to the commonly assigned U.S. Pat. No. 4,718,153, entitled CUSHION MANUFACTURING PROCESS and issued on Jan. 12, 1988 to Armitage et al., which is hereby incorporated by reference. Seat 14 has a structural shell (not shown) preferably constructed of a resilient, semi-rigid, synthetic resin material, which normally retains its molded shape, but permits some flexing such as, but not limited to, polypropylene or fiber reinforced plastic for example.

Seat 14 is preferably molded with a generally concave surface forming a shallow bowl 24 near a rear edge 26 to receive and support the buttocks of a user (FIGS. 1, 2, 5 and 6). Seat 14 becomes planar and rolls off gently toward a forward edge 28 of the seat to support the rear of the thighs of the user. Thus, seat 14 provides a gentle release of support under the user's legs, avoiding a harsh transition line where the thighs leave the support of seat 14 at front edge 28.

Figure 2:
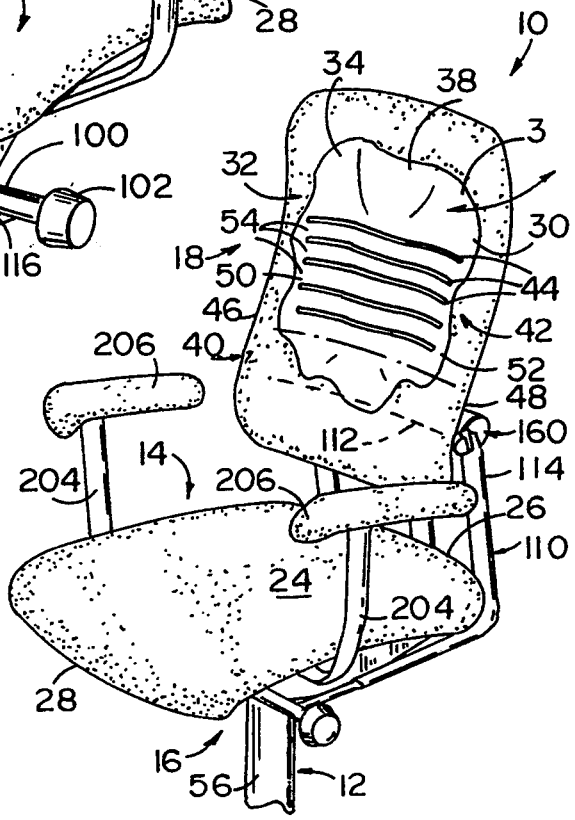
FIG. 2 is a front perspective view of the chair of FIG. 1 with a portion of the back support shell revealed.

Back 18 includes a structural shell 30 and has a complexly curved surface (FIG. 2). An upper thoracic portion 32 for contacting and supporting at least a portion of the user's upper back area, extends over the upper approximately one-third of back 18 and has two shallow, concave areas 34, 36, symmetrically positioned to either side of a center line spinal support ridge 38. Ridge 38 presents a subtly convex region between the concave areas 34, 36 to gently support the user's thoracic spine. Generally, thoracic portion 32 provides subtle, wrap-around support to the user's thoracic region.

Figure 5:
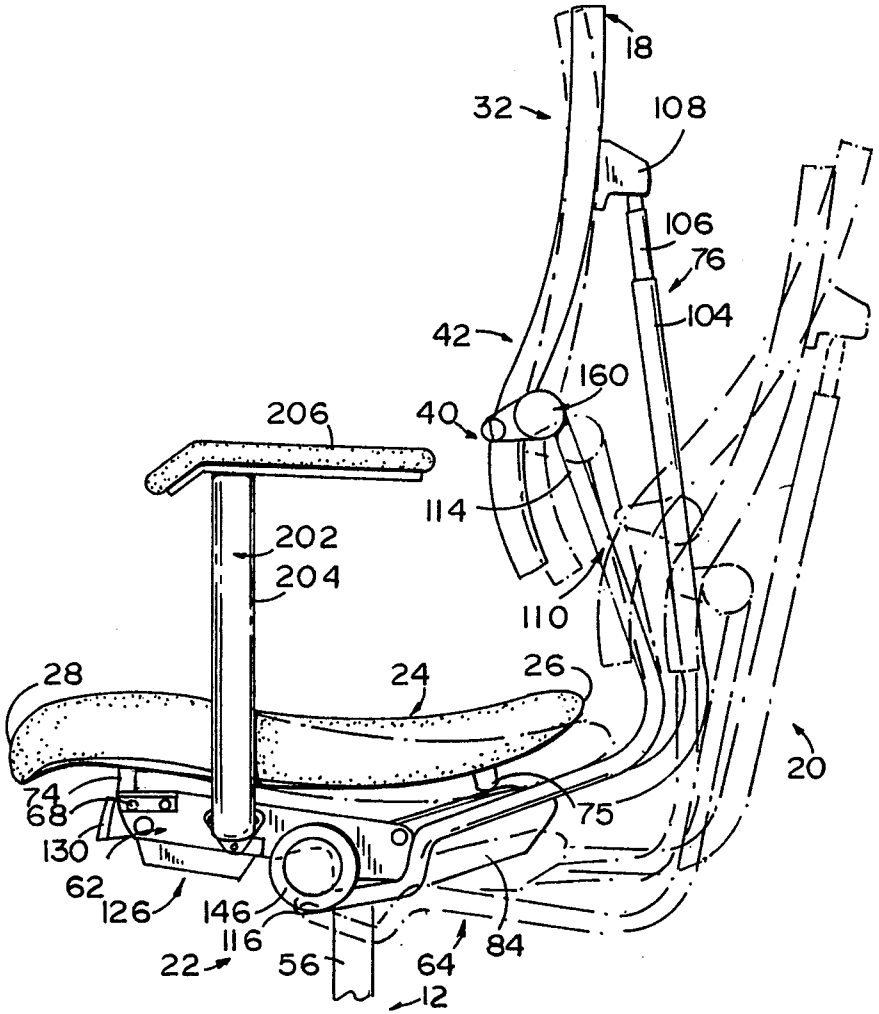
FIG. 5 is a side elevational view of the chair of FIG. 1 showing the motion of the back support structure in phantom.
Figure 6:
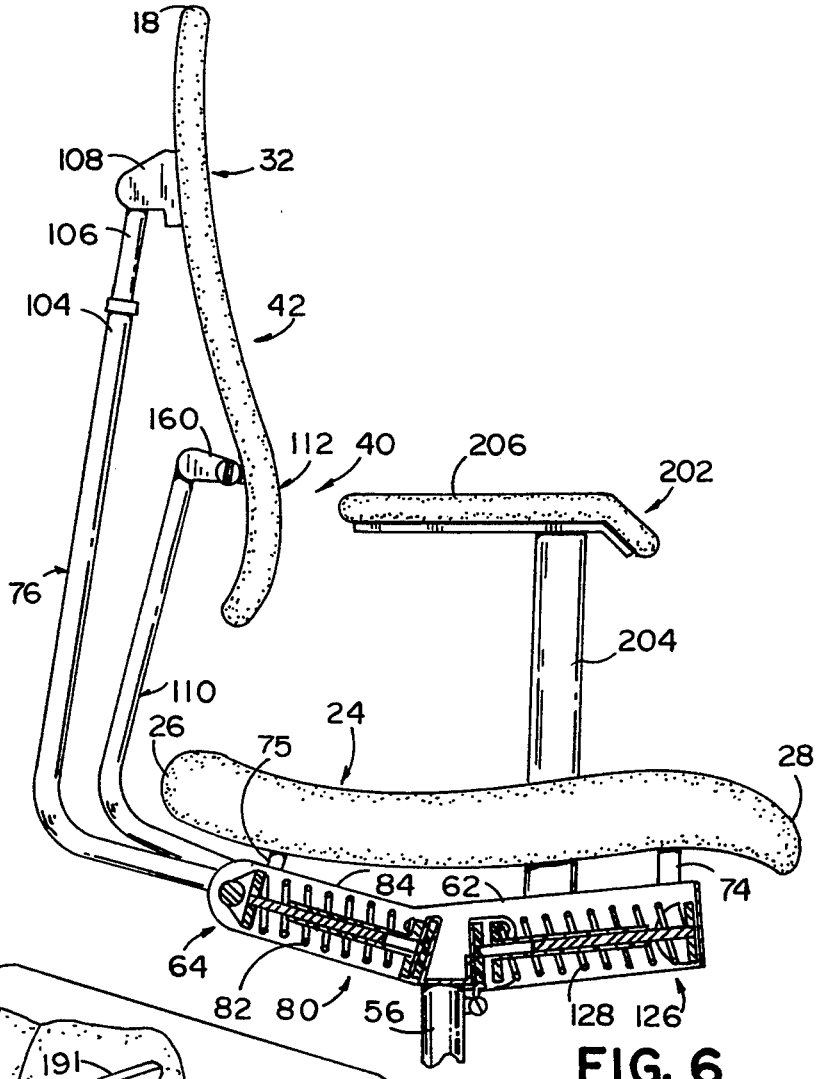
FIG. 6 is a center line sectional view of the chair of FIG. 1.

Back 18 also has a lower or lumbar portion 40 for contacting and supporting at least a portion of the lower back area of the user (FIGS. 2, 5 and 6). Lumbar portion 40 is preferably molded with a shallow, transversely concave curvature to provide subtle, wrap-around support to the lumbar region of the user's back. Lumbar portion 40 also has a longitudinally convex curvature to support the lumbar region of a user's back and provide a gentle release of support toward the user's hips, avoiding a harsh transition line.

A flexible transition area 42 extends between thoracic portion 32 and lumbar portion 40 (FIGS. 2, 5 and 6). Transition area 42 comprises a series of slits 44 extending transversely, generally horizontally, across structural shell 30 and terminating near, but spaced away from each of two opposing lateral edges 46, 48 of structural shell 30. A pair of vertically extending straps or living hinges 50, 52 are defined between slits 44 and lateral edges 46, 48. Hinges 50, 52 extend between thoracic portion 32 and lumbar portion 40. A series of transverse webs 54 are defined between slits 44. Webs 54 extend between the living hinges 50, 52.

As with seat 14, back 18 preferably has a construction comprising a molded, upholstered chair cushion assembled to structural shell 30 according to Armitage et al '153 above. Structural shell 30 is preferably constructed of a resilient, semi-rigid, synthetic resin material, which normally retains its molded shape but permits some flexing. Such material may include, but is not limited to, polypropylene, for example. Slits 44 enhance the flexibility of structural shell 30 in transition area 42, maximizing the freedom of movement between thoracic portion 32 and lumbar portion 40, yet allowing a minimal reliance between thoracic portion 32 and lumbar portion 40 for proper, generally vertical presentation of each portion 32, 40 to the user when the user sits in chair 10 (FIGS. 2, 5 and 6). Each of the thoracic and lumbar portions 32, 40 are pivotally connected with control 16, enhancing response of each portion to the user's movements. If thoracic portion 32 and lumbar portion 40 were not interconnected by flexible transition area 42, each portion 32, 40 would pivot under the pull of gravity and face generally downward when not in use, requiring inconvenient initial adjustment of each of the thoracic and lumbar portions 32, 40 by the user when initially sitting in chair 10.

Seat 10 and back 18 are connected with base 12 by control 16. Base 12 may be any of the commonly known chair bases, but preferably comprises a height adjustable column 56 supported by five equally spaced, radially extending legs (not shown), which are supported above a floor by casters (not shown), located at the end of each leg, away from column 56. An example of such a base may be found in the commonly assigned U.S. Pat. No. 4,262,871, entitled PLASTIC ENCAPSULATED BASE and issued on Apr. 21, 1981 to Kolk et al. Column 56 is preferably a telescoping unit for height adjustment of seat 14 above the floor, and most preferably has a pneumatic height adjustment mechanism 60. An example of a suitable pneumatic height adjustment mechanism is disclosed in the commonly assigned U.S. Pat. No. 4,485,996, entitled HEIGHT ADJUSTOR FOR FURNITURE and issued on Dec. 4, 1984 to Beukema et al.

Figure 7:
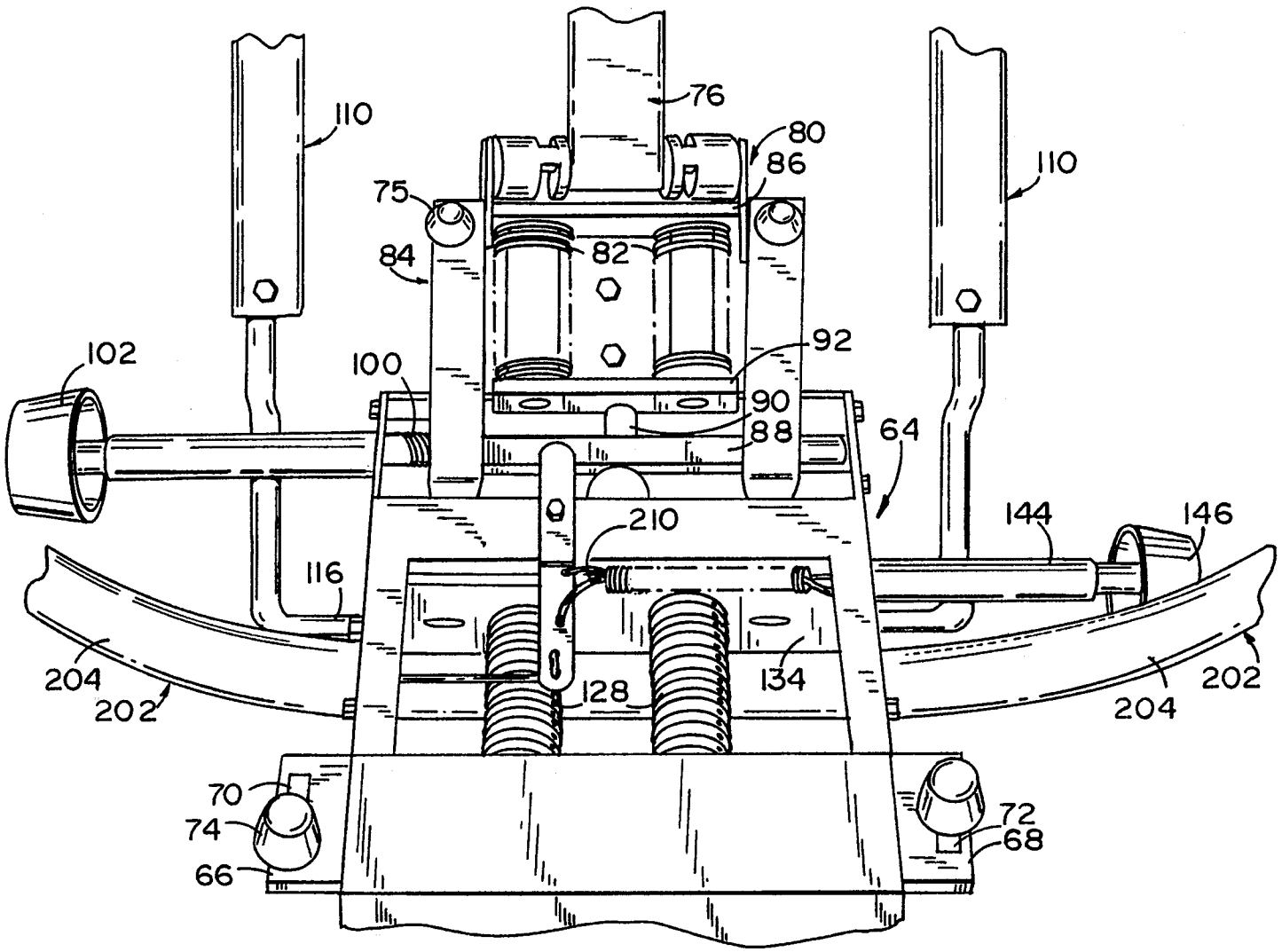
FIG. 7 is a top perspective view of the control portion of the chair of FIG. 1.

Control 16 has a stamped steel housing 62 conventionally attached to the top of base column 56, preferably by welding (FIGS. 5–7 and 9). A synchrotilt mechanism 64, described in greater detail below, is provided in a rear portion of control 16, relative to chair 10, for connection with and support of the rear area of seat 14, near rear edge 26, and thoracic portion 32. Symmetrical left and right seat mounting brackets 66, 68 are provided near the front of control housing 62 for mounting the forward area of seat 14 near forward edge 28 (FIGS. 5 and 7). Mounting brackets 66, 68 preferably allow the front portion of seat 14 to slide rearward, relative to chair 10, when thoracic portion 32 is reclined, relative to seat 14 (FIG. 5). Thus, the mounting brackets 66, 68 have elongated apertures 70, 72, respectively, and seat 14 is preferably mounted to the brackets 66, 68 by suitable fastener assemblies 74, extending through the apertures 70, 72 and slideably engaging the brackets 66, 68 (FIGS. 5 and 7).

A generally L-shaped thoracic support arm 76 is pivotally connected with control housing 62 at pivot 78 and extends rearward and upward to pivotally connect with thoracic portion 32 (FIGS. 1, 5 and 6). The rear portion of seat 14 is connected with thoracic support arm 76 by fastener assemblies 75 (FIGS. 4–7). Thus, as support arm 76 pivots rearward with the recline of thoracic portion 32, the rear area of seat 14 moves downward and rearward with thoracic support arm 76 and the front area of seat slides 14 rearward along left and right seat mounting brackets 66, 68 (FIG. 5).

Figure 9:
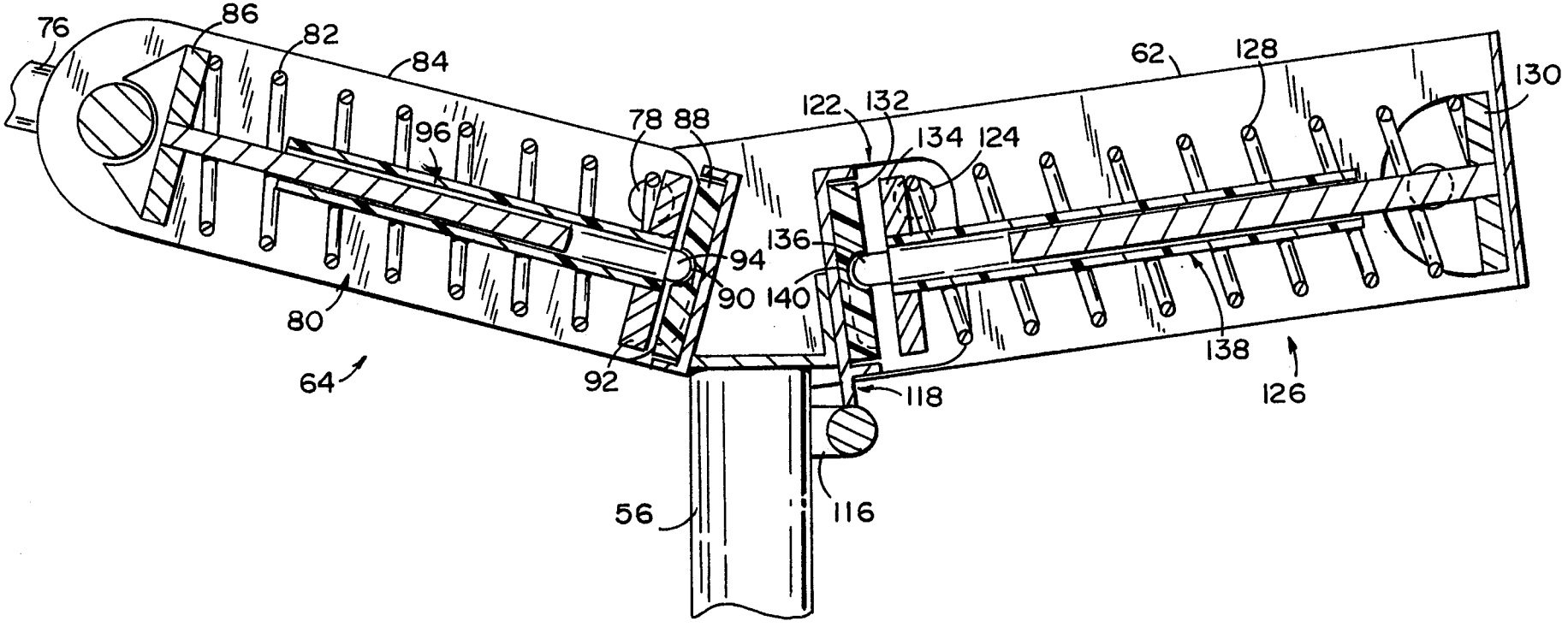
FIG. 9 is an enlarged center line sectional view of the control for the chair of FIG. 6.

Thoracic support arm 76 is biased toward a generally upright position by a thoracic energy mechanism 80, located in synchrotilt mechanism 64 and having thoracic springs 82 (FIGS. 7 and 9). Arm 76, energy mechanism 80 and synchrotilt mechanism 64 comprise thoracic support 20. Thoracic springs 82 are preloaded with a predetermined amount of compression when thoracic support arm 76 is in its normal or upright position. Thoracic springs 82 are specifically located within a synchrotilt pivot housing 84 and bear against a bearing plate 86 which is pivotally connected with synchrotilt pivot housing 84 (FIGS. 5–7 and 9). Synchrotilt pivot housing 84 is pivotally connected with control housing 62 at pivot 78 and thoracic support arm 76 is pivotally connected with housing 62 through synchrotilt pivot housing 84 (FIG. 9).

Opposite thoracic springs 82 from bearing plate 86, thoracic springs 82 press against control housing 62 through a lever arm slide plate 88 (FIG. 9). Lever arm slide plate 88 is a generally rectangular plate member having a channel or groove 90 which extends diagonally across one face of plate 88 and faces thoracic springs 82. Slide plate 88 is positioned generally below pivot 78. Thoracic springs 82 bear against slide plate 88 through a pressure plate 92 and a pressure finger 94 which projects from pressure plate 92. Pressure finger 94 projects generally away from thoracic springs 82 toward slide plate 88. Finger 94 is generally centered on pressure plate 92 and slideably engages diagonal groove 90. To assure the stability of thoracic springs 82 and that the springs do not become displaced, a telescoping stability or safety rod 96 extends through each thoracic spring 82, between bearing plate 86 and pressure plate 92. Safety rod 96 is attached to each of bearing plate 86 and pressure plate 96 and maintains the plates in a generally parallel orientation with respect to each other.

Figure 4:
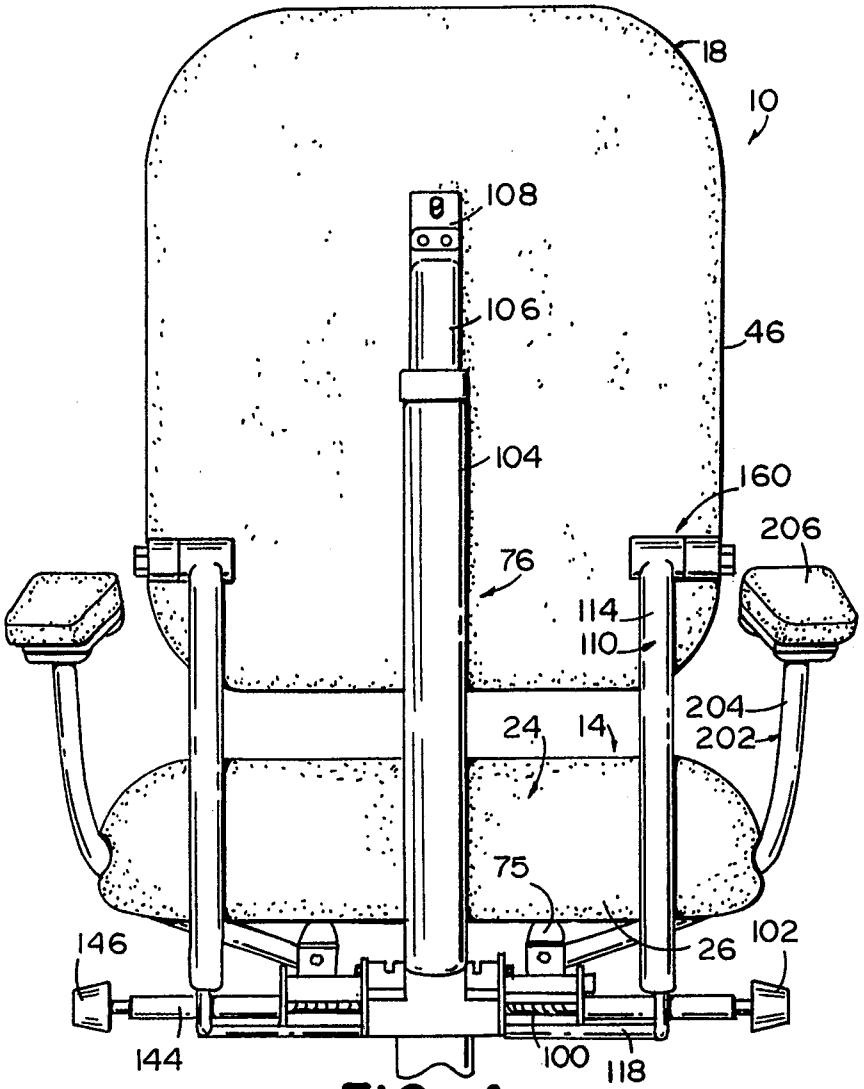
FIG. 4 is a rear elevational view of the chair of FIG. 1.

A threaded adjusting rod 100 is fixed to slide plate 88 at one end of the slide plate (FIG. 4). Adjusting rod 100 extends through control housing 62 and engages a first control nut (not shown). The control nut is rotatably mounted with control housing 62 and connected with a hand grip 102 for rotating the control nut. As hand grip 102 is manipulated, slide plate 88 is pushed or pulled laterally, relative to control housing 62 (FIGS. 7 and 9). As slide plate 88 moves laterally relative to control housing 62, slide plate 88 also moves laterally relative to pressure plate 92 and pressure finger 94. Thus, pressure finger 94 slides along groove 90 and the diagonal orientation of groove 90 moves pressure finger 94 nearer to or farther from pivot 78. This changes the geometry by which thoracic springs 82 exert energy between control housing 62 and synchrotilt pivot housing 84, adjusting the thoracic biasing force accordingly. As discussed in greater detail in commonly assigned U.S. Pat. No. 5,026,117, entitled CONTROLLER FOR SEATING AND THE LIKE and issued on Jun. 25, 1991 to Faiks et al., which is incorporated herein by reference and which teaches a similar geometry in a different structure, the biasing force is adjusted by modifying the control geometry, specifically the pivot moment arm, without changing the spring force.

Figure 3:
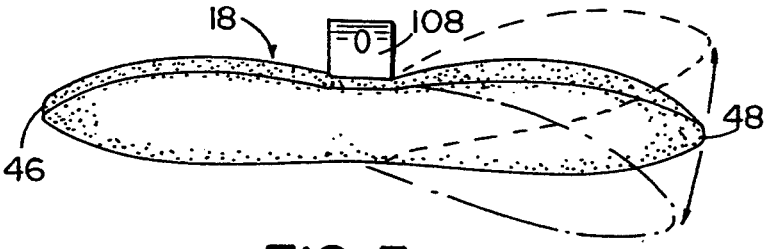
FIG. 3 is a top plan view of the back of the chair of FIG. 1 showing lateral rotation of the thoracic portion of the back in phantom.

While thoracic support arm 76 may be connected with thoracic portion 32 through a slide and track type of connecting device (not shown), thoracic support arm 76 preferably has a telescoping upper portion with an outer sleeve 104 and an inner shaft 106 which slides within outer sleeve 104 (FIGS. 1 and 4). This provides a telescopic connection between thoracic portion 32 and control 16 whereby thoracic portion 32 may freely pivot or recline rearward relative to seat 14, pivoting about lumbar portion 40. Further, thoracic support arm 76 is preferably connected with thoracic portion 32 by a ball and socket joint 108 so that thoracic support arm 76 and thoracic portion 32 are generally hingedly connected relative to rearward or reclining motion of thoracic portion 32 and so that thoracic support arm 76 and thoracic portion 32 are pivotally connected relative to lateral twisting of thoracic portion 32 (FIGS. 1–3).

A pair of generally L-shaped lumbar support arms 110 are pivotally connected with control housing 62 and extend rearward and upward to pivotally connect with lumbar portion 40 (FIGS. 1, 5 and 6). As mentioned above, lumbar portion 40 has a generally convex longitudinal curvature. This convex curvature defines an arc with an apex 112 and lumbar support arms 110 are preferably pivotally connected with lumbar portion 40 at apex 112 (FIG. 2).

Lumbar support arms 110 are generally parallel, L-shaped members pivotally connected at an end 114 with lumbar portion 40, near opposing lateral edges 46, 48 of structural shell 30 (FIG. 1). Each lumbar support arm 110 is also connected at an end 116 with a bight portion 118 (FIGS. 4 and 9). Thus, the combined structure of lumbar support arms 110 and bight portion 118 is a generally U-shaped member having the two legs of the U-shaped member bent over one side (FIGS. 1 and 9). Bight portion 118 is a generally rectangular plate member having opposed mounting brackets 120 and 122. Each mounting bracket is positioned near each end of bight portion 118 for pivotally mounting bight portion 118, and, in turn, lumbar support arms 110 to control housing 62 at pivot 124 (FIG. 9).

Lumbar support arms 110 are biased toward a generally upright position by a lumbar energy mechanism 126, provided in a forward portion of the control housing 62 (FIGS. 5–7 and 9). Arms 110, bight portion 118 and energy mechanism 126 comprise lumbar support 22. Lumbar energy mechanism 126 is quite similar to thoracic energy mechanism 80 and comprises lumbar springs 128, a bearing plate 130 pivotally connected with control housing 62, a lever arm slide plate 132 slideably mounted to bight portion 118, a pressure plate 134 and a pressure finger 136.

As with thoracic energy mechanism 80, lumbar springs 128 bear against bearing plate 130 and pressure plate 134 (FIG. 9). Each lumbar spring 128 is positioned over a telescoping safety rod 138 which extends between and connects between bearing plate 130 and pressure plate 134, maintaining bearing plate 130 and pressure plate 134 in a generally parallel orientation relative to each other. Pressure finger 136 projects generally away from lumbar springs 128 and toward slide plate 132 from pressure plate 134. Finger 136 is generally centered on pressure plate 134 and slideably engages a diagonal groove 140 formed in a face of slide plate 132 which faces pressure plate 134.

A threaded adjusting rod 144 is fixed to slide plate 132 at one end of the slide plate (FIG. 4). Adjusting rod 144 extends through mounting bracket 122 and engages a second control nut (not shown). The control nut is rotatably mounted with mounting bracket 122 and connected with a hand grip 146 for rotating the control nut. As hand grip 146 is manipulated, slide plate 132 is pushed or pulled laterally relative to bight portion 118 (FIGS. 7 and 9). As slide plate 132 moves laterally relative to bight portion 118, it also moves laterally relative to pressure plate 134 and pressure finger 136. Thus, pressure finger 136 slides along groove 140 and the diagonal orientation of groove 140 moves pressure finger 136 nearer to or farther from pivot 124. This changes the geometry by which lumbar springs 128 exert force and the lumbar biasing energy is adjusted accordingly. As discussed in greater detail in commonly assigned U.S. Pat. No. 5,042,876, entitled CONTROLLER FOR SEATING AND THE LIKE and issued on Aug. 27, 1991 to Faiks, which is incorporated herein by reference and which discloses a similar geometry in a different structure, the biasing force is adjusted by modifying the pivot moment arm without changing the spring force.

Figure 8:
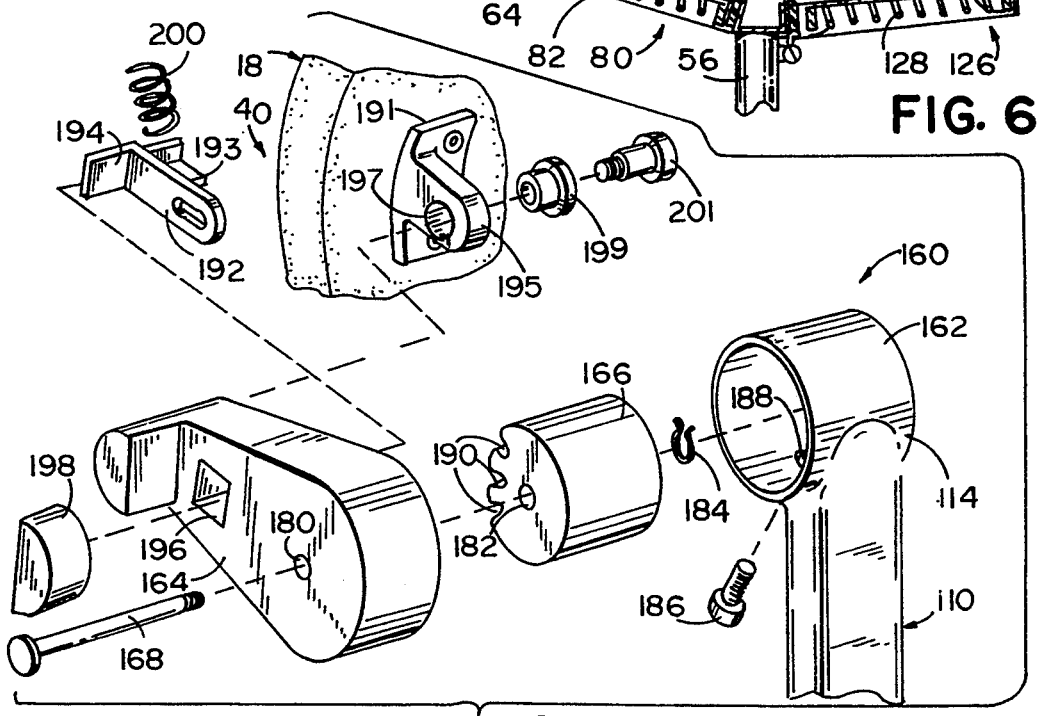
FIG. 8 is an exploded perspective view of a seat back height adjustment mechanism of the chair of FIG. 1.

Each lumbar support arm 110 is pivotally connected with lumbar portion 40 through a height adjusting mechanism 160 for adjusting the height of back 18 relative to seat 14 (FIGS. 1, 2 and 4). Each adjusting mechanism 160 has a cylindrical body portion 162 attached at end 114 of each thoracic support arm 110 (FIG. 8). An elongated lever member 164 projects generally forward from body portion 162 and pivotally connects with lumbar portion 40 at apex 112 (FIG. 2).

Lever 164 is pivotally mounted on a stub shaft 166 which projects from body portion 162 (FIG. 8). A pivot pin 168 is positioned through an aperture 180 in lever 164 and a corresponding aperture 182 in stub shaft 166 for pivotally connecting lever 164 with stub shaft 166. Pivot pin 168 is, in turn, secured with a C-clip 184. Stub shaft 166 is secured in body portion 162 by a screw 186 screwed through a threaded aperture 188 in body portion 162.

Stub shaft 166 has a series of stop notches 190 for cooperating engagement with a slide pin 192 slideably mounted in lever 164 (FIG. 8). Slide pin 192 slides along at least a portion of the length of lever 164 and includes a portion 193 which moves into and out of engagement with stop notches 190. A tab 194 projects from the side of slide pin 192 and through an aperture 196 in lever 164 for manipulation of slide pin 192 by the user. A finger grip 198 has a corresponding aperture (not shown) for force fit of grip 198 on tab 194. Slide pin 192 and portion 193 are biased toward engagement with stop notches 190 by a spring 200.

As further shown in FIG. 8, lever 164 is also pivotally connected with lumbar portion 40 of back 18, most preferably at apex 112. A flange bracket 191 is fastened to back 18 and has a projecting flange 195 with an aperture 197 for receiving a bushing 199. Bushing 199 receives a pivot screw or pin 201 which is fastened with lever 164.

Chair 10 is also preferably provided with a pair of side arms 202, having tubular support portions 204 extending outward and upward from control housing 62 and having padded arm rest portions 206 atop each support portion 204 for receiving and supporting the user's arms (FIGS. 1, 2 and 4). A chair height adjustment actuator 208 is conveniently located on one of the tubular support portions 204 adjacent to and below the corresponding arm rest portion 206 (FIG. 1). Actuator 208 may be connected to pneumatic height adjustment mechanism 60 in base column 50 by a cable 210 or the like which is threaded through the tubular support portion 204 (FIG. 7).

Operation

In use, chair 10 is quite comfortable and supportive by providing sympathetic support of the user's back. The lumbar portion 40 of back 18 is guided in a rearward and downward translation relative to seat 14 by lumbar support 22 (FIG. 5). Lumbar support 22 comprises height adjustment mechanism 160, lumbar support arms 110 and lumbar energy mechanism 126. Lumbar energy mechanism 126 imparts a biasing force through lumbar support arms 110 to lumbar portion 40. The magnitude of the biasing force may be adjusted at lumbar energy mechanism 126 by rotation of hand grip 146. As discussed above in greater detail, manipulation of hand grip 146 modifies the geometry of lumbar energy mechanism 126 and changes the biasing force applied through lumbar support arms 110 to lumbar portion 40.

Lumbar portion 40 is pivotally connected through height adjustment mechanism 160 to lumbar support arms 110. Thus, rotation of lumbar support arms 110 does not impart a rotation to lumbar portion 40 and lumbar portion 40 is free to follow the rotational inclinations of the user's lower back area. Further, the relative height of back 18 above seat 14 may be adjusted through manipulation of height adjustment mechanism 160, discussed above.

Thoracic portion 32 of back 18 is guided in a downward and rearward translation relative to seat 14 by thoracic support 20. Thoracic support 20 comprises thoracic support arm 76 and synchrotilt mechanism 64, including thoracic energy mechanism 80. Thoracic energy mechanism 80 imparts a biasing force through thoracic support arm 76 to thoracic portion 32. The magnitude of this biasing force may be adjusted at thoracic energy mechanism 80 by rotating hand grip 102 (FIG. 7).

Rotation of hand grip 102 modifies the geometry of thoracic energy mechanism 80 as discussed above and changes the biasing force imparted through thoracic support arm 76 to thoracic portion 32.

Thoracic portion 32 is connected to thoracic support arm 76 through a ball and socket joint 108 and a telescoping mechanism defined by inner shaft 106 and outer sleeve 104 (FIGS. 5 and 6). Thus, in conjunction with the pivotable connection of lumbar portion 40, thoracic portion 32 moves freely rearward, following the movement of the user's upper or thoracic back region, independently of lumbar support 22. As shown in FIG. 3, thoracic portion 32 also follows lateral twisting of the user's upper back area because of the connection of thoracic portion 32 to thoracic support arm 76, through ball and socket joint 108.

ALTERNATIVE EMBODIMENTS

Figure 10:
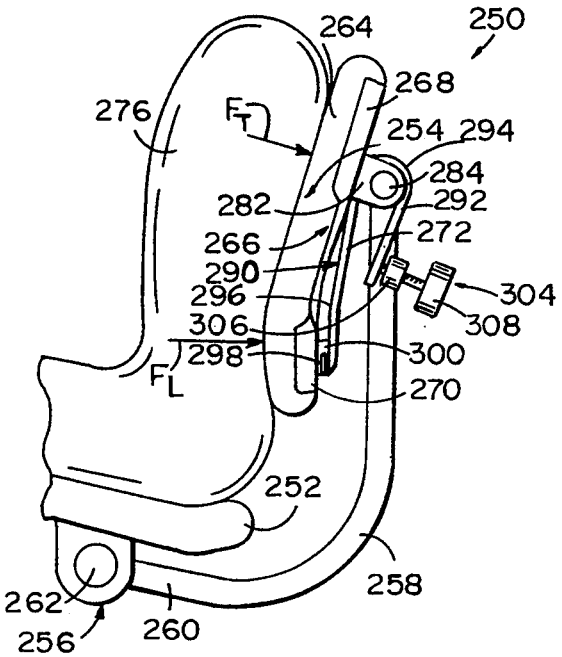
FIG. 10 is a side elevational view of an alternative embodiment of the present invention.

FIG. 10 illustrates an alternative embodiment of the present invention which is generally designated by the numeral 250. Embodiment 250 includes a seat 252 and a back support 254. Seat 252 is supported on a conventional base through a chair control 256. A back support member or arm 258 mounts back 254 to control 256. Support member 258 includes a lower end 260 pivoted to control 256 for tilting action or rotation about a transverse axis 262.

Back 254 includes a cushion 264 and a structural shell 266. As with the prior embodiment, shell 266 includes an upper thoracic portion 268 and a lower lumbar portion 270. Portions 268, 270 are interconnected by a flexible transition area 272. The lower lumbar portion of back 254, including shell portion 270, engages the lumbar area of a seated user 276. The upper thoracic portion 268 of the back 254 engages the thoracic or upper back area of the seated user.

In the embodiment of FIG. 10, back 254 is connected to control 256 and, hence, the base through the support member 258. Back 254 includes an attachment bracket 282 which is pivoted at axis 284 to the upper end of arm 258. Thoracic portion 268 of the shell, therefore, may pivot about a transverse axis independent of tilting or pivotal movement of arm 258 relative to the transverse axis 262 defined by the control 256. Seat back 254 is pivoted to arm 258 at a point above the lumbar area of a seated user and preferably proximate the thoracic area of a seated user as is described below. The pivot point is above the horizontal centerline of back 254.

Arm 258 is resiliently biased to an upright position by a conventional energy source within chair control 256. A torsion spring, for example, may engage and resiliently bias support arm 258 to the upright position. Another energy source generally designated 290 engages lumbar portion 270 of shell 272. Energy source 290 is a torsion spring, such as a torsional coil spring, leaf spring or elastomeric spring. Source 290 includes an arm 292, a base or coils 294 and another arm 296. Arm 296 includes a lower end received within a slot 298 of an attachment bracket 300. Attachment bracket 300 is fixed to lumbar portion 270.

A preload adjustment mechanism 304 is also included. Adjustment mechanism 304 includes a bracket 306 which supports a threaded adjustment member 308. Member 308 engages a lower end of arm 292 of the torsion spring. Torsion spring 290 biases lumbar portion 270 towards the lumbar region of the user independent of the positioning of the thoracic portion and support arm 258 relative to the transverse axis defined by control 256.

The energy sources 290 and 256 are independent. However, energy source 290 is mounted at the upper end of arm 258 and interconnects lumbar portion 270 to the base and chair control through support arm 258. Within a predetermined range of motion, lumbar portion 270 will move independently of the motion of thoracic portion 268.

As shown in FIG. 10, support arm 258, bracket 282 and pivot axis 284 are dimensioned and positioned so that a thoracic force $F_T$ generated by rearward pressure of the thoracic region of the majority of seated users will not rotate back 254 about axis 284 or will result in only minimal rotating or pivoting. Thoracic force $F_T$ will only tend to tilt back 254 about transverse axis 262. The back 254 will rotate only through the application of a lumbar force $F_L$ to the lumbar region of the back. The lumbar force is applied about a moment arm which tilts or pivots back 254 about pivot axis 284 against the resilient bias of energy source 290. Should the pivot axis 284 be offset from the force $F_T$, rearward movement of the thoracic would cause pivoting of back 254 about axis 284. If force $F_T$ is applied above pivot axis 284, lumbar region or portion 270 will move towards the user in a clockwise direction as the user tilts arm 258 rearwardly. If the force $F_T$ is applied below pivot axis 284, tilting of arm 258 by rearward movement of the thoracic region pivots lumbar portion 270 rearwardly or in a counterclockwise direction when viewed in FIG. 10. By positioning the pivot axis 284 to be generally centered for the average user, the thoracic and lumbar portions of back 254 are biased independently by their respective energy sources 256, 290.

Figure 11:
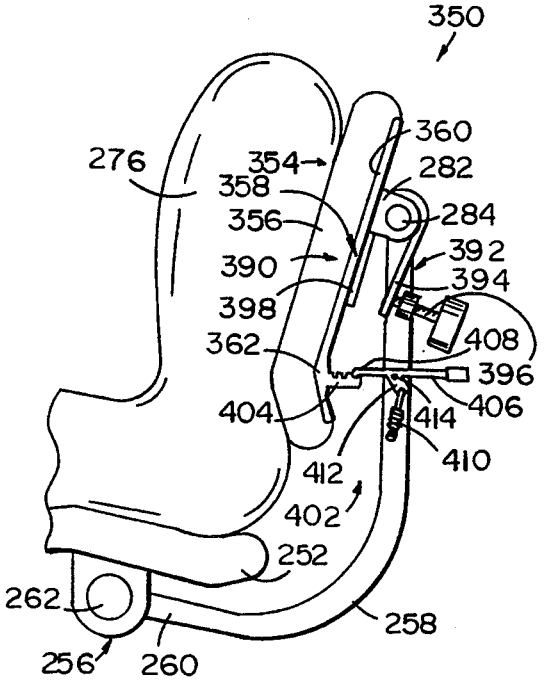
FIG. 11 is a side elevational view of another alternative embodiment showing the back in a latched position.
Figure 12:
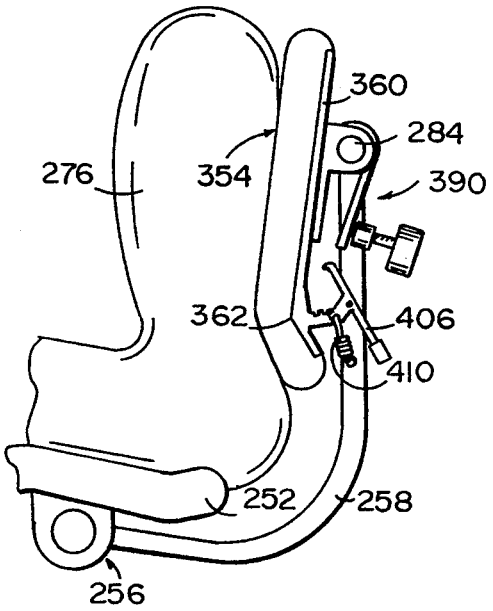
FIG. 12 is a side elevational view of the embodiment of FIG. 11 with the back in an unlatched position.

A still further alternative embodiment of a chair in accordance with the present invention is illustrated in FIGS. 11 and 12 and generally designated by the numeral 350. Embodiment 350 includes seat 252 joined to a base through chair control 256. Support arm 258 supports a back assembly 354. Back assembly 354 includes a cushion 356 and a structural shell 358. Shell 358 includes an upper thoracic portion 360 and a lower lumbar portion 362. A flexible transition area is not included between portions 360 and 362. The portions are maintained in a relatively fixed relationship with respect to each other. Seat back 352 is attached to arm 258 through bracket 282 at pivot point 284. A secondary energy source 390 includes a torsion spring 392 having a leg or arm 394 engages by a threaded adjustment member 396 and a leg or arm 398 which bears against the rear surface of shell 358.

A latch mechanism 402 is also provided. Mechanism 402 includes an engagement rack 404 and a pivoting latch member 406. Latch member 406 includes a toothed end 408 selectively engagable along rack 404. A spring 410 has an end connected to support arm 258 and another end connected to an angled link 412. Link 412 has an end which pivots about pivot point 414 of arm 406. The geometry of the link and latch member 406 provides an over-center action. When the latch mechanism is in the position shown in FIG. 11, seat back 354 is fixed with respect to arm 258. The thoracic and lumbar portions will move together upon rotation or tilting movement of support arm 258. Energy source 390 has no effect on the relative movement of the seat back portions with respect to the seat and base.

When latch 402 is released, as shown in FIG. 12, the over-center action of the spring holds the latch member 406 in an unlatched position. Energy source 390 is then operable to resiliently bias lumbar portion 260 towards the lumbar area of the seated user. Lumbar portion 262 will rotate about pivot 284 independent of rotation of the thoracic portion and support arm 258 about transverse axis 262 defined by the chair control 256.

Alternatively, an adjustable clutch plate assembly without discrete lock positions can be utilized in place of the latch mechanism shown to provide a greater degree of adjustability in the latch mechanism. An example of a suitable clutch plate assembly is shown in U.S. application Ser. No. 07/852,306, entitled CHAIR WITH BACK LOCK and filed on Mar. 18, 1992 in the name of Steffens et al.

Figure 13:
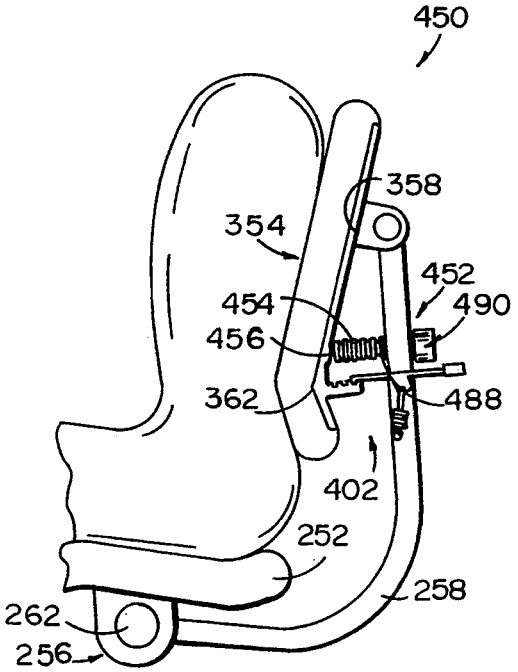
FIG. 13 is a side elevational view of a still further embodiment of the present invention.

A still further alternative embodiment of the present invention is illustrated in FIG. 13 and generally designated by the numeral 450. Embodiment 450 similarly includes seat 252, control 256, support arm 258 and back assembly 354. Energy source 390, including the torsion spring, is, however, eliminated. An alternative energy source 452 resiliently biases lumbar portion 360 towards the lumbar area of the seated user. Energy source 452 includes a compression spring 454, such as a coil spring or leaf spring. Spring 454 has an end 456 which abuts against rear surface of structural shell 358. Another end 458 of spring 454 is moveable by and engages a threaded adjustment member 490. Member 490 adjusts the preload of coil spring 454. Embodiment 450 may also includes latch mechanism 402.

The above description is considered that of the preferred embodiments only. Modifications of the invention will occur to those skilled in the art and to those who make or use the invention. Therefore, it is understood that the embodiment shown in the drawings and described above are merely for illustrative purposes and are not intended to limit the scope of the invention, which is defined by the following claims as interpreted according to the principles of patent law, including the Doctrine of Equivalents.

The embodiments of the invention in which an exclusive property or privilege is claimed are defined as follows:

1. A chair comprising:

a base;

a seat operably connected with said base;

a control operably connected with said base and disposed generally underneath said seat;

a back operably connected with said control and having a lumbar portion positioned to contact at least a portion of a lower back area of a seated adult user, and having a thoracic portion thereof positioned to contact at least a portion of an upper back area of the user;

a first support having an upper portion pivotally connected with said thoracic portion adjacent an upper portion of said thoracic portion and having a lower portion pivotally mounted in said control so that said first support pivots about a generally transverse axis and said thoracic portion rotates rearward with respect to said seat; and a second support having a portion connected with said lumbar portion for resiliently biasing said lumbar portion toward the back of the user, said second support being operatively related to said first support so that said lumbar portion rotates rearward with respect to said seat independently of rotation of said thoracic portion and said first support about said transverse axis so that the lumbar and thoracic portions follow the lower and upper areas, respectively, of the back of the user to achieve a natural, free-floating chair back motion and to provide generally continuous, sympathetic back support.

2. A chair as defined by claim 1 wherein said back further includes a flexible transition area extending between and interconnecting said thoracic and lumbar portions and providing a substantially continuous support surface for the user's back, said flexible transition area providing independent movement of said thoracic and lumbar portions for said thoracic and lumbar portions to independently follow the upper and lower areas of the user's back, respectively, and provide firm, sympathetic support of the user's back.

3. A chair as defined by claim 1 wherein said second support comprises:

a spring mounted on said first support and engaging said lumbar portion to resiliently bias said lumbar portion towards the user and wherein said thoracic portion is pivoted to said upper portion of said first support.

4. A chair as defined by claim 3 wherein said spring is a generally U-shaped leaf spring having a first leg mounted on said first support and a second leg engaging said back.

5. A chair as defined by claim 4 wherein said back further includes a flexible transition area extending between and interconnecting said thoracic and lumbar portions and providing a substantially continuous support surface for the user's back, said flexible transition area providing independent movement of said thoracic and lumbar portions for said thoracic and lumbar portions to independently follow the upper and lower areas of the user's back, respectively, and provide firm, sympathetic support of the user's back.

6. A chair as defined by claim 4 further including a bracket defining a slot, said bracket being mounted on said lumbar portion.

7. A chair as defined by claim 6 wherein said second leg of said spring rides within said slot of said bracket.

8. A chair as defined by claim 7 wherein said back further includes a flexible transition area extending between and interconnecting said thoracic and lumbar portions and providing a substantially continuous support surface for the user's back, said flexible transition area providing independent movement of said thoracic and lumbar portions for said thoracic and lumbar portions to independently follow the upper and lower areas of the user's back, respectively, and provide firm, sympathetic support of the user's back.

9. A chair as defined by claim 3 wherein said spring is a coil spring having an end supported on said first support and an end engaging the lumbar portion of the back.

10. A chair as defined by claim 3 wherein said back further includes a flexible transition area extending between and interconnecting said thoracic and lumbar portions and providing a substantially continuous support surface for the user's back, said flexible transition area providing independent movement of said thoracic and lumbar portions for said thoracic and lumbar portions to independently follow the upper and lower areas of the user's back, respectively, and provide firm, sympathetic support of the user's back.

11. A chair as defined by claim 3 wherein said thoracic and lumbar portions are rigidly interconnected by an intermediate portion of said back.

12. A chair as defined by claim 3 further including a latch on said first support for latching said thoracic and lumbar portions into a fixed relationship with respect to each other and said first support.

* * * * *